US005945923A

United States Patent [19]

Soulier

[11] Patent Number: 5,945,923

[45] Date of Patent: Aug. 31, 1999

[54] DEVICE AND METHOD FOR TRANSMITTING INFORMATION BY ELECTROMAGNETIC WAVES

[75] Inventor: Louis Soulier, Fontaine, France

[73] Assignee: Geoservices, France

[21] Appl. No.: 08/886,478

[22] Filed: Jul. 1, 1997

[30] Foreign Application Priority Data

Jul. 1, 1996 [FR] France ..... 96/08 256

[51] Int. Cl.[6] ..... G01V 3/00

[52] U.S. Cl. ..... 340/854.6; 340/854.5; 340/854.4; 340/854.9; 340/855.1; 175/40

[58] Field of Search ..... 340/854.3, 854.4, 340/854.6, 854.5, 854.8, 854.9, 855.1, 855.2; 175/40

[56] References Cited

U.S. PATENT DOCUMENTS

| | | | |
|---|---|---|---|
| 3,967,201 | 6/1976 | Rorden | 340/854.5 |
| 4,093,936 | 6/1978 | Eberline et al. | 340/18 |
| 5,163,714 | 11/1992 | Issenman | 285/54 |
| 5,394,141 | 2/1995 | Soulier | 340/854.4 |
| 5,396,232 | 3/1995 | Mathieu et al. | 340/854.5 |
| 5,512,889 | 4/1996 | Fletcher | 340/854.6 |

FOREIGN PATENT DOCUMENTS

| | | |
|---|---|---|
| 87/05238 | 9/1987 | WIPO . |
| 92/06278 | 4/1992 | WIPO . |

*Primary Examiner*—Michael Horabik
*Assistant Examiner*—Jean B. Jeanglaude
*Attorney, Agent, or Firm*—Millen, White, Zelano, & Branigan, P.C.

[57] ABSTRACT

A device and method for transmitting information between a well bottom and the surface by means of electromagnetic waves. The device includes transmitting information on either side of a valve (9) placed in a string of pipes (4) in a well by means of two electromagnetic wave transmitter-receiver unit (1, 2) placed on either side of the valve. In the device, unit (2) placed above valve (9) is lowered by means of logging type cable (3) into inner space of pipes (4).

20 Claims, 1 Drawing Sheet

DEVICE AND METHOD FOR TRANSMITTING INFORMATION BY ELECTROMAGNETIC WAVES

FIELD OF THE INVENTION

The present invention applies to the field of production testing of wells drilled in a geologic formation, generally in order to evaluate qualitatively and quantitatively the effluents contained in the geologic formation crossed by the wellbore. This type of test, referred to as DST for "Drill Stem Test", is generally performed while drilling an exploration well. However, these tests can be performed in production wells at the start of or during the production phase, without departing from the scope of the present invention.

The present invention relates to a device for transmitting, notably in real time, information on either side of a test valve placed in a string of pipes commonly referred to as test string, the string being introduced into a well drilled in the ground according to conventional procedures.

BACKGROUND OF THE INVENTION

There are various systems allowing to know, in real time and from the surface, the pressures, temperatures, flow rates, etc, at a point of a well situated below a test valve while this valve can be open or closed according to the operational phase of the test: flowing or buil-up phase.

Some systems use a hydraulic channel situated in the wall of the test string which communicates the volume under pressure situated below the test valve with pressure gages situated above the valve. The measurements performed by these gages are thereafter transmitted to the surface via an electric cable connected to a sub comprising special electronic means. Connection is achieved by coupling by means of a mutual induction transformer or of a current loop.

Other systems use an acoustic transmission in the body of the test string, for example according to document WO-92/06,278.

The major drawback of the former systems is that they require a test string and more precisely a test valve comprising integration of a hydraulic passage. This assembly type is very complex and very expensive as regards manufacture and maintenance. Besides, in these systems, the electric or mutual inductance connection of the electric cable connecting the measuring means situated above the test valve to the surface is very sensitive to the nature of the fluid present within the production tubing. In particular, transmission is very difficult when the fluids are conductive.

The system illustrated by document WO-92/06,278 also requires an electric type connection between the receiver situated above the valve and the electric cable. Whether a mutual induction connection or a link by means of an electric connector in a liquid environment (wet connector), the drawbacks are the same as with the other known systems.

Furthermore, in these solutions, the transmission distance is limited to practically a pipe length, i.e. about ten meters. Consequently, the connector fastened to the lower end of the electric cable will necessarily be positioned about ten meters above the test valve. If the well produces an effluent containing sand, the latter sediments after closure of the flow rate corresponding to the closure of the test valve, thus forming a plug that can be several ten meters high, which can prevent proper operation of the connector, anchoring or loosening thereof.

SUMMARY OF THE INVENTION

The present invention thus relates to a device for transmitting information between a well bottom and the ground surface, said well comprising an array of pipes divided in a lower part and an upper part by means intended to seal the inner space of said pipes, seal assembly means between said pipes and said well. In the device, said lower part comprises a first unit including information acquisition means and electromagnetic signal transmission and reception means, a second electromagnetic signal transmission and reception unit being placed in the inner space of the upper part of the pipes by operating means comprising at least one electric or optical communication line running up to the surface and said second unit comprises means of electric contact with said pipes.

The first and the second unit can comprise means for injecting a low-frequency current along the pipes.

The first unit can comprise a toric transformer substantially concentric with respect to the axis of the pipes. The second part of the transformer can be a single spire consisting of the pipes forming a loop with the casing or the ground.

The operating means can be made up of at least one cable length with coaxial conductors and an external metal armoring.

The upper part of the pipes can comprise an electric insulation means placed between two pipe elements. In this case, at least one of the contact means between the second unit and the pipes is situated between the insulation means and the seal means.

The information acquisition means can comprise at least one pressure detector and a temperature detector.

The operating means of the second unit can include means of contact with the pipes on which the electromagnetic current circulates, said contacts being advantageously spaced out by several meters.

The well can be cased by a metal casing, and the portion of pipes contained between said units can be partly insulated electrically from said casing by centering means.

The pipes can comprise at least two means of electric contact with the metal casing, the contacts being situated on either side of said portion of centered pipes.

One means of contact with the metal casing can consist of said seal assembly means.

The information acquisition means can be remote-controlled from the surface through the channel of the line and of the electromagnetic transmission between said two units.

The invention further relates to a method for transmitting information between a well bottom and the ground surface, said well comprising an array of pipes separated in a lower part and an upper part by means intended to seal the inner space of said pipes, seal assembly means between said pipes and said well, information acquisition means. In the method, an electromagnetic current carrying said information is transmitted from the lower part to the upper part by a front unit placed below said seal means and a second unit placed in the inner space of the upper part, and said information is transmitted to the surface by an electric or optical communication line connecting said second unit to the ground surface.

Information acquisition can be remote-controlled from the surface through the channel of said line and of the first and second unit.

Said second unit can be operated above the seal means by means of a logging type coaxial cable.

Bi-directional communication can be obtained between said two units by injecting a sinusoidal electric current of programmable intensity and frequency, the frequency preferably ranging between 1 and 200 Hz.

BRIEF DESCRIPTION OF THE DRAWINGS

Other features and advantages of the present invention will be clear from reading the description hereafter given by way of non limitative examples, with reference to the accompanying drawings wherein.

DESCRIPTION OF THE INVENTION

Figure 1:
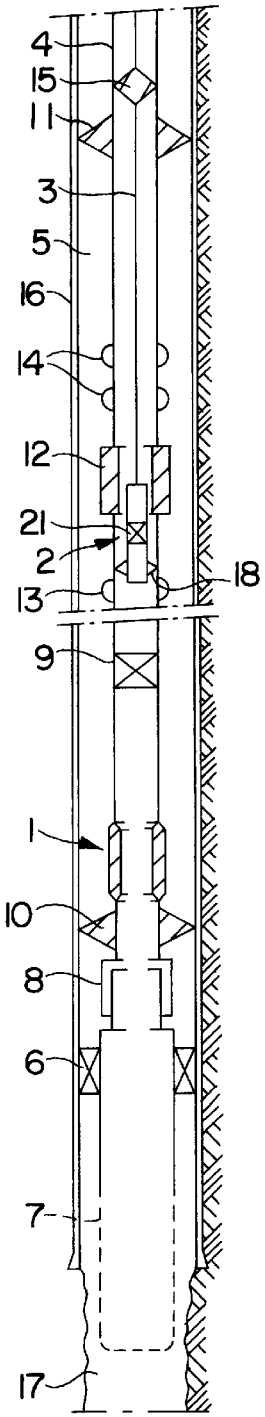
FIG. 1 illustrates a flowsheet of the device according to the invention.

In FIG. 1, the device which is the object of the present invention comprises a first communication unit 1 equipped with transmitter/receiver means and with various measuring means, notably pressure and temperature detectors. The device also comprises a second communication unit 2 referred to as shuttle, equipped with transmitter/receiver means complementing first unit 1 and means of bi-directional digital telemetry with the surface through the channel of a (logging type) cable 3 comprising electric conductors or optical fibers. Cable 3 is operated in pipes 4 by means of a surface installation known to the technicians concerned, i.e. a winch and a cab for controlling, recording and processing the signals that transit through the communication lines integrated in cable 3.

Pipes 4 are lowered into a well 5 drilled through a geologic bed from which the effluents that may be contained in the bed pores are to be produced. To that effect, a string referred to as test string and comprising units 1 and 2, a packer type seal means 6 intended to provide an annular seal around the pipes, a strainer 7 placed below the packer and intended to allow access of the effluent towards the inner space of pipes 4, a slip joint 8 and/or a jar intended to allow setting and facilitate withdrawal of the packer, a test valve 9 that can be opened or closed several times in order to open or to close communication between the geologic bed and the inner space of pipes 4 communicating with the surface, is assembled at the end of pipes 4. Other conventional equipments, not shown here, can complete the test string: circulating sub, safety joint, etc.

In the situation shown in FIG. 1, well 5 is cased by a steel pipe 16, generally cemented in the borehole. The pay zone/hole connection is achieved either through perforations through the casing pipe or by drilling 17 beyond the shoe of string 16. In this configuration, the test string preferably comprises contacts 10 and 11, for example in the form of centralizers with metal strips, the packer or natural contacts provided by an array of pipes offset in a well. One arranges it so that contact points 10 and 11 are as spaced out as possible along the string, on either side of valve 9, and at least separated by more than a pipe segment, i.e. at least 10 meters.

In the present example, i.e. transmission during a DST or any other equivalent configuration, from one side of a test valve to the other, a certain number of precautions are preferably taken so that the two links of the first unit 1, forming a transformer type transmitter/receiver, with contacts 10 and 11 forming the poles are not electrically interrupted. One ensures for example that no equipment of slip joint or jar type is interposed between the two contact points 10 and 11. If this cannot be avoided, electric continuity is checked and, if need be, provided by means of a suitable device integrated in the equipment involved, slip joint or jar. Furthermore, these precautions allow to use packer 6 as the lower pole insofar as it practically always has anchor hooks providing electric contact on string 16. If unit 1 is of the insulating junction type and not of the transformer type, there will be an electric interruption substantially at the level of the transmission/reception dipole of unit 2 and unit 1, according to the very principle of the insulating junction type transmission.

Units 1 and 2 communicate with each other by means of electromagnetic currents guided by casing 16 and/or the test string. Frequencies ranging between some Hertz and a few hundred Hertz are generally used. These waves are modulated by phase-shift keying (PSK) in order to convey information. Units 1 and 2 being situated most often within a casing 16, it is highly advantageous to create the largest possible injection dipole so as to generate behind the casing the largest possible propagation signal. Such a dipole is described in document U.S. Pat. No. 5,394,141 mentioned here by way of reference. If it is not possible to form a large dipole, operation of the present transmission device is still possible. However, in this case, the transmission distance between unit 1 and unit 2 and/or the information rate can be reduced in order to decrease the noise energy according to well-known signal-to-noise ratio improvement principles.

In case of creation of a large dipole, it is advantageous to avoid contact between the test string and casing 16. It is possible to use standard rubber pipe protectors or any other insulating ring 13 and 14 mounted on a pipe element and interposed in the test string at suitable distances. It can be noted that whatever the nature of the fluid in the test string/well annulus, including brines, the conductivity difference between the fluid and the pipes of the string constitutes an apparent dipole of more than 10 meters, which is generally enough for the present transmission.

The transmitter/receiver of each unit 1 and 2 of the present device intended to inject or to receive the carrier frequency propagated along the test string can be made by means of a well-known technique, i.e. either an insulating junction such as that described in document U.S. Pat. No. 5,163,714 or an extended dipole, or a transformer whose toric magnetic circuit surrounds unit 1. The primary winding comprises a number of spires suited to the electric power supply, whereas the secondary winding comprises a single spire made up of the test string closing on the casing via contacts 10 and 11.

The second transmitter/receiver unit 2, referred to as shuttle, comprises an insulating link 21 and a lower means of electric contact 18 with the inside of pipe 4, and said means can be made either of hooks anchored in a corresponding groove machined in a sub screwed on pipes 4 or of extractable pads remote-controlled from the surface via the electric link intended for transfer of the measured data.

The second pole, or upper pole, of the transmission/reception dipole consists of the metal armoring of the (logging type, for example) coaxial cable 3. This cable being sufficiently centered in the pipes up to a height where there is a contact point 15, it can be in contact with the wall of the pipes only at a sufficiently great distance, thus allowing a transmitter/receiver dipole of great length to be created. Contact 11 is preferably situated below contact point 15 or in the neighbourhood thereof However, if this large dipole cannot be created, equivalent results would be obtained by using a sub comprising an insulating junction 12 situated above contact means 18 and below contact point 15 of the coaxial cable armoring with the casing. Using a sub comprising an insulating junction 12 thus imposes a given position of the shuttle with respect to the junction since contact 18 must be situated below insulating junction 12 and contact 15 above sub 12. In fact, in this case, the position of the insulating junction must be decided prior to the building up, at the surface, of the test string that is to be lowered into the well. It is however possible to place it several ten meters above the test valve.

Figure 2:
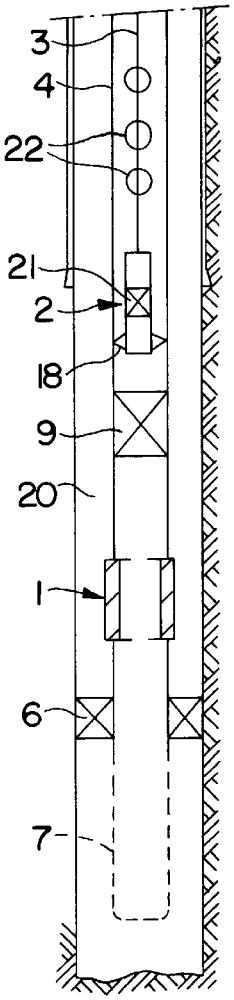
FIG. 2 illustrates another implementation of the device.

FIG. 2 shows the configuration where well 20 is not cased by a steel casing. The test string comprises at least a strainer 7, a packer 6, a test valve 9 assembled with pipes 4. The first unit 1 comprises measuring means, electronic and electromagnetic means providing communication by electromagnetic waves with shuttle 2. Shuttle 2 is lowered into the inner space of the pipes, above test valve 9, by means of a cable 3 comprising at least one electric or optical communication line. Unit 2 or shuttle comprises electric contact means 18, preferably in the form of remote-controlled fingers or wipers. The shuttle comprises an insulating link 21 so as to form a first lower pole by means of contact 18 and a second pole with the armoring of cable 3. In order to prevent the contact between the cable armoring and pipes 4 from being too close to the lower pole, the cable can be surrounded, if need be, with insulating 22 or centering elements over a sufficient height. It is clear that this configuration imposes no precise position of the shuttle with respect to the test string, unless an insulating sub similar to that 12 described in FIG. 1 is used for the purpose of a yet higher performance transmission.

Figure 3:
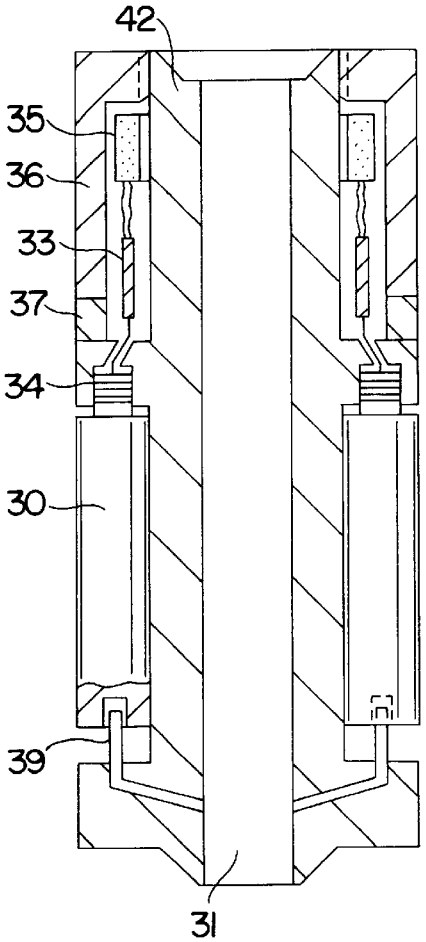
FIG. 3 is a diagram of a unit of the device.

FIG. 3 illustrates a sectional view of an embodiment of unit 1, the latter having at least three functions:

measurement of at least the pressure and the temperature below test valve 9, transmission of these data to the second unit 2 situated above the test valve, reception and interpretation of a signal emitted by shuttle 2.

Figure 4:
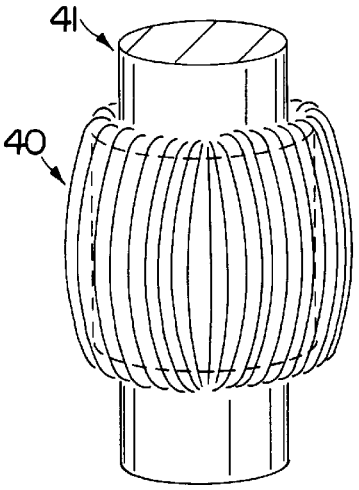
FIG. 4 shows the principle of the transformer type transmitter/receiver.

Measurement of the pressure and of the temperature is performed by three standard gages 30 referred to as memory gages, supplied by three independent energy sources. Measurements are stored in a non-volatile memory with a sampling frequency programmed at the surface by an operator. Each gage measures, according to preference, the internal pressure in channel 31 via line 32 or the pressure in the annulus, i.e. outside unit 1. Gages 30 are connected to an electronic cartridge 33 by means of an electric connection 34. Electronic cartridge 33 collects the data measured by one of the three gages and injects a signal, preferably in the form of a phase-shift keyed (PSK) low-frequency electromagnetic current representative of these data, towards torus 35. FIG. 4 shows the principle of an embodiment and of the operation of a toric transformer whose primary circuit 40 is connected to transmitter/receiver 33 and the secondary circuit has a single spire 41 consisting of the internal shaft 42 of unit 1. Shaft 42 is mechanically and electrically connected to the DST string and allows to convey the electric current to unit 2, thus providing bi-directional communication between units 1 and 2. A cap 36 secured to unit 1 is electrically insulated at least at one of its ends 37 while protecting torus 35 and electronic cartridge 33.

In the transmission mode of a signal from the surface to unit 1, via shuttle 2, a phase-shift keyed low-frequency signal is emitted by the shuttle. It is received by torus 35 and processed by electronic cartridge 33. This signal allows for example to modify the operating mode of unit 1. The two main operating modes can be:

a mode referred to as "Real Time" mode, wherein the data provided by one or more gages are transmitted in real time to the shuttle, then to the surface by means of the cable, a mode referred to as "Play-Back" mode, with multiplexed type emission of data in real-time and of the previously measured data. This mode allows to know all the data measured from the switching on of the gages to the present time. In particular, it allows to have access, while the test is in progress, to the data corresponding to the phase referred to as the flowing phase, while unit 2 is generally lowered during the valve closure phase (build-up) which takes place after the well flowing phase.

The operation control signal, emitted from the surface, also allows to select the gage that will be read by the electronic cartridge.

It can be noted that the data are also stored in each gage 30 and can also be read at the surface at the end of the test.

Second unit 2 or shuttle (FIG. 1 and FIG. 2) is connected to the surface by a coaxial cable 3. The cable allows power supply of the electronic compartment included in the shuttle and bi-directional dialogue between the shuttle and the surface.

The electronic compartment mainly consists of an electromagnetic transmitter/receiver and of a bi-directional electric transmitter allowing dialogue with the surface via the cable conductors.

The electromagnetic transmitter of the shuttle generates a phase-shift keyed low-frequency signal between the cable armoring and contact means 18, these two points being electrically insulated by insulating junction 21. The shuttle generates this signal on reception of an order signal coming from the surface via the coaxial cable. The signal generated by the shuttle is received, then decoded by unit 1, thus allowing it to modify its operating mode. Similarly, the shuttle can inject or receive an electromagnetic current by using means comprising a transformer.

The electromagnetic receiver of the shuttle receives, then decodes the low-frequency signal emitted by unit 1. This signal is measured between the armoring of cable 3 and contact 18. It is generally representative of the data measured by the gages of unit 1.

When the data are decoded, they are transmitted to the surface by means of the cable.

Apart from ensuring electric contact between the shuttle and the test string, contact means 18 also ensure mechanical anchoring of the shuttle in the test string. This anchoring can be necessary if, as when an insulating sub 12 is used in the test string, a determined position of the shuttle is required or if the effluent flow rate is likely to create untimely displacements or vibrations which may disturb the proper operation of the transmission.

The preceding examples can be repeated with similar success by substituting the generically or specifically described reactants and/or operating conditions of this invention for those used in the preceding examples.

The entire disclosure of all applications, patents and publications, cited above and below, and of corresponding French application No. 96/08256, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

I claim:

1. A device for transmitting information between the bottom of a well (5) and the ground surface, said well comprising an array of pipes (4) separated in a lower part and an upper part by means (9) intended to seal the inner space of said pipes, seal assembly means (6) between said pipes and said well, wherein said lower part comprises a first unit (1) including information acquisition means and electromagnetic signal transmission and reception means, a second electromagnetic signal transmission and reception unit (2) is placed in the inner space of the upper part of the pipes by operating means (3) comprising at least one electric or optical communication line running up to the surface and said second unit comprises means (18, 15) of electric contact with said pipes.

2. A device as claimed in claim 1, wherein the first and the second units (1, 2) comprise means for injecting a low-frequency electric current along pipes (4).

3. A device as claimed in claim 2, wherein said first unit (1) comprises a toric transformer (35) substantially concentric with respect to the axis of said pipes (4).

4. A device as claimed in claim 1, wherein said operating means (3) comprises at least one cable length with coaxial conductors and a metal external armoring.

5. A device as claimed in claim 1, wherein the upper part of the pipes comprises an electric insulation means (12) placed between two pipe elements.

6. A device as claimed in claim 5, wherein at least one (18) of the contact means between said second unit and the pipes is situated between said insulation means (12) and said seal means (9).

7. A device as claimed in claim 1, wherein said information acquisition means comprise at least a pressure detector and a temperature detector.

8. A device as claimed in any claim 1, wherein said means (3) intended to operate second unit (2) comprise means (15) of contact with the pipes situated several meters away from second unit (2).

9. A device as claimed in claim 1, wherein well (5) is cased by a metal casing (16) and the portion of pipes contained between said units (1, 2) is substantially insulated electrically from said casing by centering means (13, 14).

10. A device as claimed in claim 9, wherein said pipes (4) comprise at least two means (6, 10, 11) of electric contact with the metal casing situated on either side of said portion of centered pipes.

11. A device as claimed in claim 10, wherein one of the means of contact with the metal casing consists of said seal assembly means (6).

12. A method for transmitting information between the bottom of a well (5) and the ground surface, said well comprising an array of pipes (4) separated in a lower part and an upper part by means (9) intended to seal the inner space of said pipes, seal assembly means (6) between said pipes and said well, information acquisition means, wherein said information is transmitted through an electromagnetic current from the lower part to the upper part by a first unit (1) placed below said seal means (9) and a second unit (2) placed in the inner space of the upper part, and said information is transmitted to the surface through an electric or optical communication line connecting said second unit to the ground surface.

13. A method as claimed in claim 12, wherein information acquisition is remote-controlled from the surface through the channel of said line (3) and of the second and first units (1, 2).

14. A method as claimed in claim 12, wherein said second unit is operated above the seal means by means of a logging type coaxial cable.

15. A method as claimed in claim 12, wherein bidirectional communication is established between said two units by injecting a sinusoidal electric current of programmable intensity and frequency.

16. A method as claimed in claim 13, wherein said second unit is operated above the seal means by means of a logging type coaxial cable.

17. A method as claimed in claim 13, wherein bi-directional communication is established between said two units by injecting a sinusoidal electric current of programmable intensity and frequency.

18. A method as claimed in claim 14, wherein bi-directional communication is established between said two units by injecting a sinusoidal electric current of programmable intensity and frequency.

19. A method as claimed in claim 16, wherein bidirectional communication is established between said two units by injecting a sinusoidal electric current of programmable intensity and frequency.

20. A device as claimed in claim 3, wherein well (5) is cased by a metal casing (16) and the portion of pipes contained between said units (1,2) is substantially insulated electrically from said casing by centering means (13,14).

* * * * *